US005277050A

United States Patent [19]

DeRoss et al.

[11] Patent Number: 5,277,050

[45] Date of Patent: Jan. 11, 1994

[54] ELECTRICAL CONNECTOR CRIMPING TOOL

[75] Inventors: Robert DeRoss, Naperville; Ronald Dudek, Orland Park, both of Ill.

[73] Assignee: Molex Incorporated, Lisle, Ill.

[21] Appl. No.: 943,965

[22] Filed: Sep. 11, 1992

[51] Int. Cl.[5] ..... H01R 43/048

[52] U.S. Cl. ..... 72/403; 29/753

[58] Field of Search ..... 72/403, 397, 410; 29/753, 751

[56] References Cited

U.S. PATENT DOCUMENTS

| | | | |
|---|---|---|---|
| 2,845,108 | 7/1958 | Hammell | 72/403 |
| 2,928,299 | 3/1960 | Fuller | 72/403 |
| 2,981,130 | 4/1961 | Broske | 29/751 |
| 3,091,276 | 5/1963 | Aquillon | 29/753 |
| 3,531,971 | 10/1970 | Robb | 72/410 |
| 3,570,097 | 3/1971 | Bowden | 29/753 |
| 3,883,938 | 5/1975 | Schmidt | 29/753 |
| 4,790,173 | 12/1988 | Boutcher, Jr. | 72/446 |

*Primary Examiner*—Daniel C. Crane

*Attorney, Agent, or Firm*—A. A. Tirva; Charles S. Cohen

[57] ABSTRACT

A crimping tool is provided for compressing a terminal onto an electrical wire. The tool includes an anvil having a terminal engaging surface area. A ram is reciprocally movable toward and away from the anvil and has a terminal engaging surface area opposing the terminal engaging surface area of the anvil for compressing the terminal therebetween. A second ram is movably mounted on one of the anvil and ram in the respective terminal engaging surface area thereof for selectively compressing the terminal to an extent greater than that afforded by the anvil and the ram alone.

8 Claims, 2 Drawing Sheets

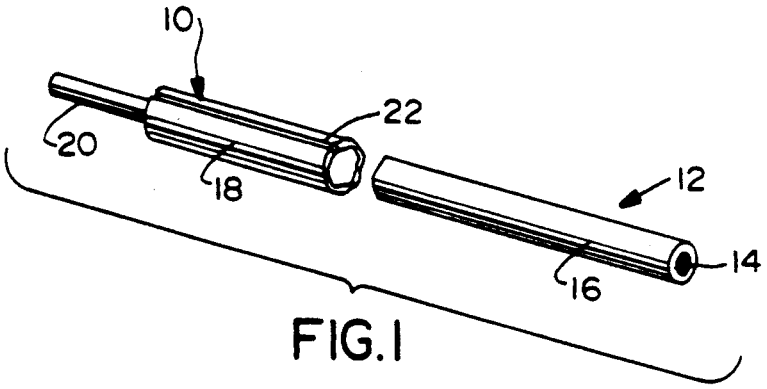
FIG.1
FIG.2
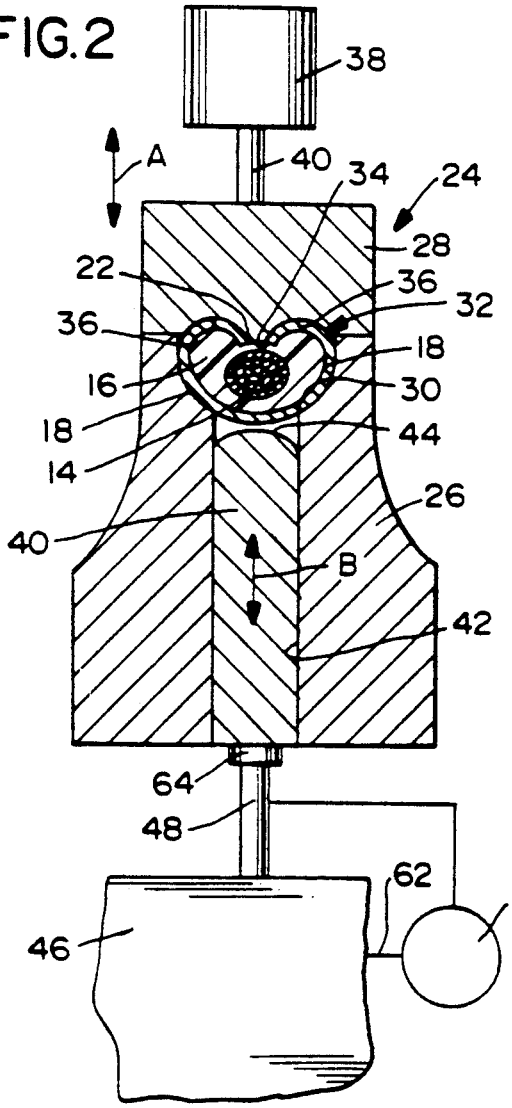
FIG.3
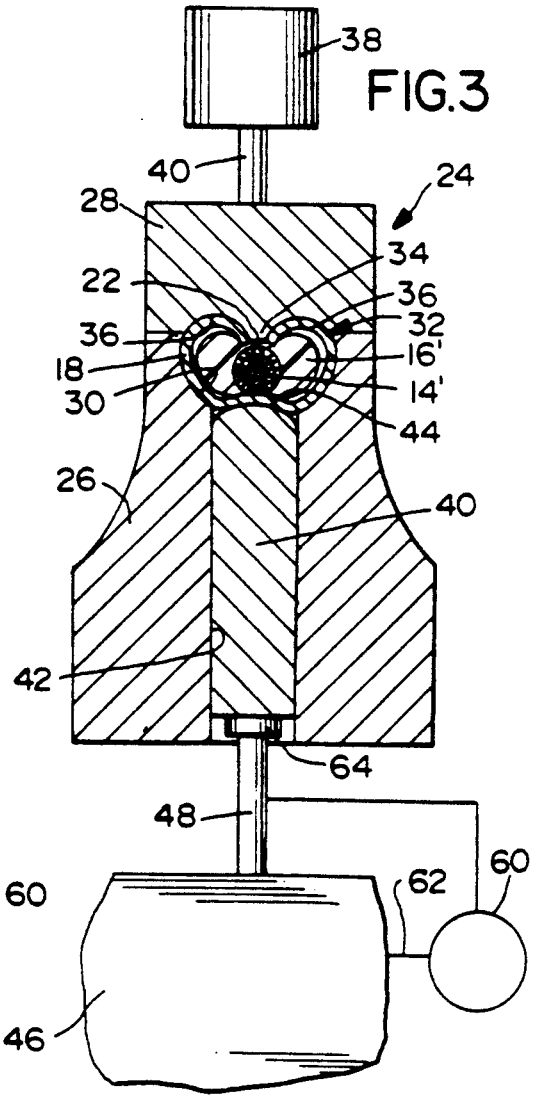

ELECTRICAL CONNECTOR CRIMPING TOOL

FIELD OF THE INVENTION

This invention generally relates to the art of application tooling for electrical connectors and, particularly, to a crimping tool for compressing a terminal onto a conductor.

BACKGROUND OF THE INVENTION

There are many application tools, presses, and the like for terminating a wide variety of electrical connectors to their respective terminals. One type of application tooling involves compression tools for crimping metal connectors about electrical conductors to form an electrical and/or structural connection between two conductors or between a conductor and a terminal. Two conductors may be inserted into opposite open ends of a connector splice, or one conductor may be inserted into an open end of a terminal, with the opposite end of the terminal providing a mating connection for a complementary terminal. The terminal then is crimped, such as by a hydraulic compression tool, to structurally lock the conductor(s) to the terminal and/or to establish electrical conductivity therewith.

Many types of terminals are used with electrical connectors as described above, including a commonly used terminal having a cylindrical portion which is crimped onto the exterior of an insulated electrical wire having a central conductor or core. The terminal commonly is fabricated as a stamped and formed metal component, with a cylindrical crimpable portion having an open seam. The edges of the seam conventionally are crimped onto the exterior of the insulated wire to provide strain relief between the wire and the terminal.

One of the problems with terminating electrical connections of the character described above, is that the insulated electrical wires are used in a variety of sizes or diameters. Obviously, compression tools can be provided with interchangeable dies for crimping a terminal onto different sized wires whereby the dies can be interchanged to accommodate either the differences in sizes or the differences in forces desired to terminate the different wires. However, such interchangeable dies often are cost prohibitive in mass production environments, particularly in the down time required to change the tooling every time a terminal is crimped to a different size wire.

One solution to the above problem is to provide an adjustable compression tool in which the total crimping height between the crimping dies is adjusted to accommodate smaller wires, for instance, in a larger crimping area. This commonly is called adjusting the "shut height" of the crimping tool. For instance, U.S. Pat. No. 4,790,173, dated Dec. 13, 1988, discloses a type of tool which provides means for adjusting the shut height of the crimping sections thereof. Such tools not only are fairly complicated, but their range of adjustment is limited by the very product involved. In other words, there is a fairly wide range of electrical wire sizes or diameters, and, if a crimping "area" between opposing compression dies is large enough to accommodate a large diameter wire, that same area is too large to crimp and terminate a relatively small wire simply by adjusting the shut height of the opposing dies or tool sections.

This invention is directed to solving the above problems by providing a crimping tool which has practically an infinite range of adjustment without having to interchange the compression tool dies or crimping sections.

SUMMARY OF THE INVENTION

An object, therefore, of the invention is to provide a new and improved crimping tool for compressing a terminal onto a conductor.

In the exemplary embodiment of the invention, the crimping tool has an anvil including a terminal engaging area. A ram is reciprocally movable toward and away from the anvil and has a terminal engaging area opposing the terminal engaging area of the anvil for compressing the terminal therebetween. A second ram is movably mounted on one of the anvil and ram in the respective terminal engaging area thereof for selectively compressing a terminal to an extent greater than that afforded by the anvil and ram alone. Therefore, the terminal engaging areas of the anvil and the ram can be utilized for crimping a terminal onto a relatively large diameter electrical wire, and the second ram additionally can be utilized for crimping the terminal onto a relatively small diameter electrical wire.

As disclosed herein, the terminal engaging area of the anvil is in the form of a concave surface for receiving a rounded terminal, such as a stamped and formed "seamed" portion of a terminal. The terminal engaging area of the ram is in the form of a generally V-shaped surface for crimping onto the terminal, the apex of the V-shape crimping into the seam of the terminal to drive the seam edges against or into the insulation of the conductor. The second ram is movably mounted in the anvil, within the bounds of the concave surface thereof, and has a convex terminal engaging surface opposing the V-shaped terminal engaging surface of the ram. Therefore, when it is desired to crimp a relatively small diameter wire, the second ram can be used to increase the crimping capability or range of the tool, without requiring any interchangement of the terminal engaging sections of the tool or without requiring a complicated adjusting means, as are prevalent with the prior art.

The invention also contemplates pressure adjusting means operatively associated with the second ram. Sensor means also can be provided operatively associated between the pressure adjusting means and the second ram for limiting the pressure applied by the second ram to a predetermined value.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic illustration of one type of terminal, and electrical wire with which the crimping tool of the invention is applicable;

FIG. 2 is a sectional view through the crimping tool, illustrating the terminal crimped onto the wire by the anvil and ram of the tool, and with the second ram being inoperative;

FIG. 3 is a view similar to that of FIG. 2, illustrating the terminal crimped to a smaller diameter wire, and with the second, ram being operable;

DETAILED DESCRIPTION OF THE PREFERRED EMBODIMENT

Figure 4:
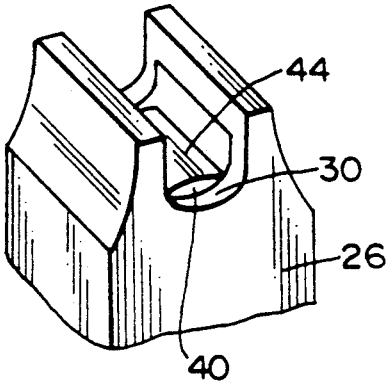
FIG. 4 is a fragmented perspective view of the anvil, showing the disposition of the second ram therewithin.

Referring to the drawings in greater detail, and first to FIG. 1, it should be understood that the basic concepts of the crimping tool of this invention are applicable for compressing a wide variety of terminals onto a wide variety and different sizes of electrical wires. However, FIG. 1 shows one type of terminal, generally designated 10, for terminating an electrical wire, generally designated 12, the wire being a conventional electrical wire having a conductive core 14 surrounded by insulation 16. The core may be solid or stranded. Terminal 10 may be an electrical contact, having a crimpable portion 18 and a contact portion 20. Although not shown, contact portion 20 could be a male contact, a female contact, a hermaphroditic contact or the like. Crimpable portion 18 is shown in the form of a cylindrical sleeve which has a longitudinal open seam 22, as would be created by rolling the terminal in a stamped and formed manufacturing process. As will be described in greater detail hereinafter, electrical wire 12 is inserted into terminal 10 and the terminal is crimped onto the wire, structurally locking the terminal to the wire.

Of course, as stated, the crimping tool of this invention can be used with a wide variety of terminals and electrical connecting devices or wires. For instance, simply referring to FIG. 1, sleeve 18 could be provided, alone, for terminating the ends of opposing conductors inserted into the opposite ends of the sleeve to conductively splice the conductors.

Referring to FIGS. 2–4, a crimping tool, generally designated 24, is illustrated somewhat schematically to include an anvil 26 and a ram 28. The anvil and the ram may comprise the dies or crimping sections of a larger crimping apparatus. Anvil 26 has a terminal engaging area 30, and ram 28 has a terminal engaging area 32. As seen particularly in FIG. 4, terminal engaging area 30 of anvil 26 is in the form of a generally concave surface means for receiving a rounded terminal, such as sleeve 18 of terminal 10 as described in relation to FIG. 1. Terminal engaging area 32 of ram 28 is generally V-shaped, defining an apex 34 with rounded concave surface sections 36 on opposite sides of the apex, for purposes described hereinafter.

Means are provided for reciprocally moving ram 28 toward and away from anvil 26, as indicated by double-headed arrow "A" (FIG. 2). Specifically, a device 38 is shown with a shaft-like projection 40 connected to the top of ram 28. One example of a motive means is a pneumatic piston and cylinder apparatus wherein device 38 is the cylinder and shaft 40 is the piston of the apparatus. Of course, other types of motive means are contemplated, such as reversible motor driven screw apparatus, stepper motors and the like.

As will be described in greater detail hereinafter, the invention, generally, contemplates providing a second ram movably mounted on one of the anvil or the ram in the respective terminal engaging area thereof for selectively compressing a terminal to an extent greater than that afforded by the anvil and the ram alone. In the illustrated embodiment, the second ram is operatively associated with the anvil to apply a compressing or crimping force opposing the apex of the V-shaped terminal engaging surface of the ram. However, the basic concepts of the invention are considered to have wider applications than that shown in the preferred embodiment herein.

More particularly, FIGS. 2–4 show a second ram 40 mounted in a bore 42 for reciprocal movement therewithin toward and away from ram 28, as indicated by double-headed arrow "B". Second ram 40 has an upper convex terminal engaging surface 44. As with ram 28, appropriate motive means are provided for moving the second ram, such as a piston and cylinder apparatus including a cylinder 46 and a piston 48. Of course, other apparatus, such as a reversible motor driven screw device, a stepper motor device or the like could be used.

Figure 5:
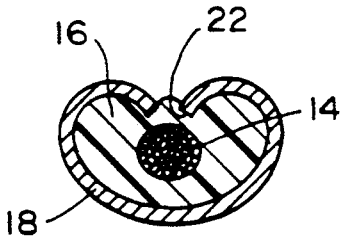
FIG. 5 is a section through a crimped terminal and electrical wire, of a relatively large diameter.
Figure 6:
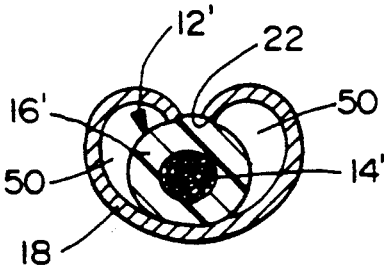
FIG. 6 is a view similar to that of FIG. 5 illustrating the inability of the ram and anvil to crimp the terminal onto a smaller diameter electrical wire.
Figure 7:
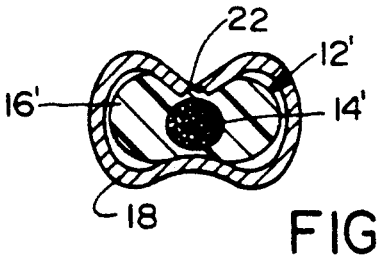
FIG. 7 is a view similar to that of FIG. 6, illustrating how the second ram is effective to crimp the terminal onto the smaller diameter wire.

The operation and advantages of the invention are best understood by referring to FIGS. 5–7 in conjunction with FIGS. 2 and 3. Turning first to FIG. 5 in conjunction with FIG. 2, it can be seen that a relatively large electrical wire is illustrated as having been crimped by employing anvil 26 and ram 28. It can be seen that sleeve 18 of the terminal substantially fills the crimping area between concave terminal engaging surface 30 of anvil 26 and the V-shaped terminal engaging surface 32 of ram 28. The electrical wire substantially fills sleeve 18, and the edges of the sleeve along seam 22 have been driven against or into insulation 16. It should be understood that, as illustrated in FIG. 2, second ram 40 has been inoperative during such a crimping operation for the relatively large electrical wire.

Turning to FIG. 6, a considerably smaller electrical wire, generally designated 12', including insulation 16' and core 14', is disposed within sleeve 18, the sleeve being shown crimped to the same extent as illustrated in FIGS. 2 and 5. It immediately can be seen that anvil 26 and ram 28 have an insufficient "shut height" to completely drive the edges along seam 22 of sleeve 18 into the insulation of the wire. The crimped sleeve provides sufficient structural engagement or strain relief on the wire. As stated above, heretofore, attempts have been made to solve this problem by providing means for adjusting the shut height of the crimping dies of a compression tool, such as anvil 26 and ram 28. However, not only are such adjustable apparatus fairly complicated, but it can be understood by comparing FIGS. 5 and 6 that there is a wide range in diameters of electrical wires, and shut height adjustments simply are too limited to accommodate both the sizes of wires shown in FIGS. 5 and 6. In other words, there simply is too much area, as indicated at 50 (FIG. 6), between the terminal and the wire. If the dies were configured to accommodate the smaller conductor shown in FIG. 6, there would be too much of a gap between the dies to uniformly crimp sleeve 18 onto a larger conductor as shown in FIG. 5.

All of the problems and dilemmas described above are solved by the invention of providing second ram 40 for use in conjunction with anvil 26 and ram 28 to compress the terminal to an extent greater than that afforded by the anvil and the ram alone. More particularly, referring to FIGS. 3 and 7, it can be seen that second ram 40 has been driven upwardly so that its convex terminal engaging surface 44 crimps sleeve 18 opposite the direction of ram 28. In the illustrated embodiment, the second ram crimps the sleeve opposite the apex 34 of the terminal engaging surface of ram 28. This drives the edges of the sleeve along seam 22 against or into insulation 16' to establish a strain relief on the smaller wire. It should be noted that the side bounds of sleeve 18 have not been deformed and are substantially the same as when the sleeve is terminated to the larger diameter wire as shown in FIGS. 2 and 5.

The invention also contemplates providing some control for second ram 40 to prevent the ram from excessive crimping into sleeve 18 which might destroy the integrity of a stranded conductor. More particularly, referring to FIG. 1, a schematic illustration is illustrated whereby a pressure adjusting means 60 is operatively associated with motive means 46, 48, as at 62. The pressure adjusting means is illustrated schematically, because its nature would depend upon the nature of the motive means. For instance, if the motive means is a pneumatic piston and cylinder device, the pressure adjusting means could be preset to adjust the pressure in the cylinder depending upon the size of wire to be terminated. This would limit the pressure applied to the wire so the integrity of the conductor core is not destroyed. If the motive means is a stepper motor apparatus, of course it is known that an adjusting means can be provided to adjust the cycle of the motor. The same would be true for a motorized screw apparatus which is cyclically operated to move second ram 40 in a reciprocal motion as indicated by double-headed arrow "B".

The invention also contemplates that a sensor 64 can be provided in operative association between pressure adjusting means 60 and the second ram, with the pressure adjusting means including a microprocessor for controlling motive means 46, 48. The sensor could be preadjusted for a given amount of reactive force, such as anchoring the sensor to anvil 26 and being operatively associated with movable second ram 40. When the second ram is activated by the motive means 46, 48, the ram would be cycled through the microprocessor controlled adjusting means 60 in response to a predetermined sensed force, the adjusting means being operative on the motive means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A crimping tool for compressing a terminal onto an insulated electrical wire, the terminal having an open seam lengthwise thereof, the crimping tool comprising:

a fixed anvil having a concave terminal engaging surface area for receiving a side of the terminal opposite said seam;

a first ram reciprocally movable toward and away from the anvil in order to crimp the terminal and having a generally V-shaped terminal engaging surface area opposing the concave terminal engaging surface area of the anvil, the apex of the V-shaped surface area being effective to compress edges of the terminal along said seam against the insulation of the electrical wire, said first ram being adapted to be reciprocally moved by first motive means; and a second ram movably mounted within the bounds of the concave terminal engaging surface area of the anvil for selectively compressing the terminal to an extent greater than that afforded by the anvil and the ram alone, said second ram being adapted to be reciprocally moved by second motive means separate from said first motive means.

2. The crimping tool of claim 1 wherein said second ram has a convex terminal engaging surface area.

3. The crimping tool of claim 1, including pressure adjusting means operatively associated with said second ram.

4. The crimping tool of claim 3, including sensor means operatively associated between the pressure adjusting means and the second ram for limiting the pressure applied by the second ram to a predetermined value.

5. The crimping tool of claim 3, including motive means for operating said second ram, and said pressure adjusting means are operatively associated with the second ram by coupling the pressure adjusting means to the motive means to control operation of the motive means.

6. The crimping tool of claim 5, including sensor means operatively associated between the pressure adjusting means and the second ram for limiting the pressure applied by the second ram to a predetermined value.

7. The crimping tool of claim 6 wherein said second ram is adapted to only engage a portion of said terminal that is compressed onto the insulation of said insulated electrical wire.

8. The crimping tool of claim 1 wherein said second ram is adapted to only engage a portion of said terminal that is compressed onto the insulation of said insulated electrical wire.

* * * * *